US005512797A

United States Patent [19]

Kim et al.

[11] Patent Number: 5,512,797

[45] Date of Patent: Apr. 30, 1996

[54] ELECTRON GUNS FOR COLOR PICTURE TUBE

[75] Inventors: Won H. Kim; Hee S. Lee, both of Kyungsangbook-Do; Hee W. Yun, Daeku; Sung G. Ahn, Kyungsangbook-Do; Sung H. Cho, Kyungsangbook-Do; Myeong W. Lee, Kyungsangbook-Do; Hyeon C. Kim, Kyungsangbook-Do, all of Rep. of Korea

[73] Assignee: Goldstar Co., Ltd., Rep. of Korea

[21] Appl. No.: 279,591

[22] Filed: Jul. 22, 1994

[30] Foreign Application Priority Data

Jul. 24, 1993 [KR] Rep. of Korea ..... 14124/1993

[51] Int. Cl.[6] ..... H01J 29/48

[52] U.S. Cl. ..... 313/414; 313/412; 313/439; 313/460

[58] Field of Search ..... 313/414, 412, 313/416, 425, 428, 432, 439, 460, 458

[56] References Cited

U.S. PATENT DOCUMENTS

| | | | |
|---|---|---|---|
| 4,086,513 | 4/1978 | Evans, Jr. | 313/414 |
| 4,208,610 | 6/1980 | Schwartz | 313/414 |
| 4,374,342 | 2/1983 | Say | 313/414 |
| 4,772,827 | 9/1988 | Osakabe | 313/414 X |
| 5,128,586 | 7/1992 | Ashizaki et al. | 313/414 |
| 5,281,892 | 1/1992 | Kweon et al. | 313/414 |
| 5,300,855 | 4/1992 | Kweon | 313/414 |

FOREIGN PATENT DOCUMENTS

| | | |
|---|---|---|
| 59-215640 | 12/1984 | Japan . |
| 89-3825 | 5/1984 | Rep. of Korea . |

*Primary Examiner*—Sandra L. O'Shea
*Assistant Examiner*—Ashok Patel
*Attorney, Agent, or Firm*—Ostrolenk, Faber, Gerb & Soffen

[57] ABSTRACT

In-line electron guns for color picture tube improving the resolution of the color picture tube. The guns not only exhibit the special quality of a large aperture of lens but also achieve the desired mechanical strength of electrodes by arranging ⊂-shaped inner electrode plates in the envelope electrodes respectively. Each of first and second accelerating/focusing electrodes for focusing three electron beams of the electron beam sources on the phosphor screen includes an envelope electrode and an electrostatic field control electrode placed in the envelope electrode. The envelope electrode includes a predetermined length of hollow envelope part and a predetermined width of rim part extending from an edge of the hollow envelope part. The electrostatic field control electrode includes a plate electrode sided by predetermined width of blades at opposed sides thereof. This blade sided plate electrode is holed at its center so as to have a center beam passing opening.

18 Claims, 9 Drawing Sheets

ELECTRON GUNS FOR COLOR PICTURE TUBE

BACKGROUND OF THE INVENTION

1. Field of the Invention

The present invention relates in general to electron guns for color picture tubes and, more particularly, to a structural improvement of in-line electron guns for color picture tube for improving the resolution of color picture tube.

2. Description of the Prior Art

In a typical in-line color picture tube having in-line guns or an arrangement of three electron guns in a horizontal line, a deflection yoke having deflection magnetic fields are placed around the neck of the color picture tube. With the deflection magnetic fields of the deflection yoke, there are generated astigmatism and coma aberration of electron beams in the color picture tube and this makes the focus characteristics of a phosphor screen of the color picture tube more deteriorated in comparison with another type of color picture tube.

FIG. 1 shows a structure of a typical in-line color picture tube. As shown in this drawing, the in-line color picture tube 3 comprises a glass panel 1 and a funnel 2, which panel and funnel are integrally formed with each other. Provided in back of the panel 1 and spaced apart from the panel 1 at a given interval is a phosphor screen 9. The phosphor screen 9 is applied with three color phosphors, that is, red, green and blue color phosphors, in the form of vertical stripes on its surface. The three color phosphors convert the absorbed kinetic energy of the electron beams 4 (4R, 4G, 4B) into emitted beam spots. A color selection electrode or a shadow mask 6 is mounted in back of the phosphor screen 9 and spaced apart from the screen 9 at a given interval. The shadow mask 6 is a thin, perforated mask for selection of colors of the three electron beams 4R, 4G and 4B. The holes in the mask 6 are positioned to ensure that the electron beams strike the color phosphor strips of the screen 9. In the above in-line color picture tube, three electron guns 5 for emitting the three electron beams 4R, 4G and 4B are axially arranged in a horizontal line in the neck 7, thus to form the so-called in-line electron guns. In FIG. 1, the axial direction of the color picture tube is Z—Z direction. Mounted around the neck 7 of the tube 3 is a deflection yoke 8 that deflects the three electron beams 4R, 4G and 4B of the in-line electron guns 5.

The inside of the above in-line color picture tube shows a degree of vacuum typically ranged from $10^{-6}$ Torr to $10^{-7}$ Torr.

Representative example of such an in-line electron guns 5 is shown in an enlarged view of FIG. 2. As shown in this drawing, the in-line guns 5 include three electron beam sources or three cathodes 10 that emit their respective electron beams or R, G and B beams and are placed in the horizontal line. The three axes of the cathodes 10 are aligned with centers of their respective openings of two grids or first and second grids 11 and 12. The in-line guns 5 also include main lenses comprising third to sixth grids 13, 14, 15 and 16. The cathodes 10 and the first to sixth grids 11 to 16 are arranged in the axial direction Z—Z of the tube 3 and spaced out at predetermined intervals. The cathodes 10 as well as the first to sixth grids 11 to 16 are fixedly received in a pair of insulating bead glasses 17 of the rod type. The in-line guns further include a shielding cup or a shielding electrode 13 in front of the sixth grid 16. This shielding electrode 18 shields and weakens the leaked magnetic fields of the deflection yoke 8. A heater (not shown) is received in each cathode 10.

Each of the first to sixth grids 11 to 16 is provided with three openings for passing the three electron beams 4R, 4G and 4B of the cathodes 10 therethrough respectively. The three openings of each grid of the guns 5 are arranged in the horizontal line or in the horizontal direction X—X which is perpendicular to the electron beam passing direction. This beam passing direction is equal to the axial direction Z—Z of the color picture tube. The three openings of each grid is also arranged in the same plane.

In the above in-line guns 5, the first and second grids 11 and 12 are plate type electrodes. However, the sixth grid 16 and the fifth grid 15 facing each other are noncircular cylinder electrodes respectively as shown in FIGS. 3 and 4. The sixth grid 16 is otherwise stated as an anode and, hereinbelow, referred to "the second accelerating/focusing electrode" while the fifth grid 15 is otherwise stated as a focus electrode and, hereinbelow, referred to "the first accelerating/focusing electrode".

FIG. 3 is a partially broken perspective view showing representative examples of the first and second accelerating/focusing electrodes. In these drawings, the first and second accelerating/focusing electrodes are designated by the numerals 15 and 16 respectively. The electron beams 4 (4R, 4G and 4B) radiated from the cathodes 10 pass through the first and second accelerating/focusing electrodes 15 and 16 so as to be focused on the phosphor screen 9. Such focusing of the electron beams on the phosphor screen 9 will be referred to FIG. 1.

FIG. 4 is a front view of an accelerating/focusing electrode section of the in-line guns 5 when the tube 3 is cross sectioned at the neck 7. As shown in FIG. 4, each diameter of the circular openings 15*a*, 15*b*, 15*c*, 16*a*, 16*b*, 16*c* of the first and second accelerating/focusing electrodes 15 and 16 is generally ranged from 5.5 mm to 5.9 mm. In each electrode 15, 16, the regular intervals or bridge width $l_1$ between the openings 15*a*, 15*b*, 15*c*, 16*a*, 16*b*, 16*c* are ranged from 0.8 mm to 1.2 mm. Meanwhile, the interval $l_2$ between an outside opening of a electrode 15, 16 and the side end of the electrode 15, 16 is ranged from 1.0 mm to 1.4 mm. The circular openings 15*a*, 15*b* and 15*c* of the first accelerating/focusing electrode 15 are offset from the circular openings 16*a*, 16*b* and 16*c* of the second accelerating/focusing electrode 16 respectively by a predetermined distance. It is preferred to let the two groups of openings be offset from each other by a distance ranged from about 0.1 mm to about 1.2 mm. The offset distance of the beam passing openings is affected by both color picture tube size and applied voltage.

In the above in-line color picture tube 3 having three electron guns, the holes in the shadow mask 6 are positioned to ensure that the three beams of the cathodes 10 strike the screen 9. The kinetic energy of each electron beam striking the screen 9 is converted by the phosphors into emitted spots, thus to develop a color image on the screen 9. Here, the emitted spots or pixels caused by the electron beams 4 are important factors that exert a remarkable influence on the resolution of the color picture tube.

The operation of the above in-line guns 5 will be described in detail hereinbelow.

As shown in FIG. 2, the electron beam sources or the cathodes 10 emit their thermions due to heat of their heaters. The thermions are controlled as to their amounts in the electron beams by the first grid 11 and are, thereafter, accelerated by the second grid 12. In this regard, the first and second grids 11 and 12 can be characterized as a control grid and a screen grid respectively.

The second grid 12 is typically applied with voltage not higher than 1000 volt. The third grid 13 is applied with voltage of about 20–30% of voltage of the second accelerating/focusing electrode 16.

Due to potential difference between the second and third grids 12 and 13, a weak electrostatic lens or a pre-focus lens is formed between the second and third grids 12 and 13. At the pre-focus lens between the second and third grids 12 and 13, the diverging angles of the beams 4 or the inclination angles of the beams with respect to the direction Z—Z after the beams are transmitted through the pre-focus lens are determined. That is, the incident angles of the beams at the main lenses were already determined by the pre-focus lens. Hence, the pre-focus lens is an important factor influencing the focus characteristics of the guns 5.

The pre-focus lens has the collateral function of shielding against possible infiltration of electric field of the third grid 13 into the cathodes 10.

After passing through the pre-focus lens, the electron beams 4 (4R, 4G and 4B) are accelerated while retaining their predetermined diverging angles and, thereafter, received by the main lenses. The electron beams are in turn focused on the phosphor screen 9 by the main lenses, thus to generate emitted spots and to develop the color image on the screen 9.

At this time, the second accelerating/focusing electrode 16 of the main lenses is applied with high voltages ranging from about 22,000 volt to 35,000 volt. The first accelerating/focusing electrode 15 is applied with mid-range voltages of about 20–33% of the high voltages of the second accelerating/focusing electrode 16. There is thus generated a potential difference between the first and second accelerating/focusing electrodes 15 and 16 so that the main lenses are formed between the two electrodes 15 and 16. The main lenses affect the focus characteristics of the electron beams 4 (4R, 4G and 4B).

The circular openings 15*a* to 15*c* and the circular openings 16*a* to 16*c* facing each other are spaced out at an interval of 0.8 mm–1.2 mm. In addition, the circular openings 15*a* to 15*c* are offset from the circular openings 16*a* to 16*c* respectively by the distance of about 0.1 mm–1.2 mm as described above. In this regard, the main lenses for the side electron beams are axially asymmetrical in the Z—Z direction. The side electron beams are thus converged into the center electron beam so that the three electron beams 4 (4R, 4G and 4B) are converged into a single point.

Such convergence of the three electron beams is a so-called static convergence (STC) of the electron guns 5.

In the above in-line guns 5, each of the main lenses has a small aperture of about 5.5 mm–5.9 mm. The main lenses should be thus affected by spherical aberration.

In an effort to reduce the bad effect of the spherical aberration, a multi-stage beam focusing technique is preferably used.

The electron guns 5 shown in FIG. 2 are guns of the multi-stage focusing type. In the above guns 5, the second grid 12 is electrically connected to the fourth grid 14 while the third grid 13 is electrically connected to the first accelerating/focusing electrode 15.

In the above in-line electron guns 5 for color picture tube 3, one of causes of deterioration of the resolution of the color picture tube is known as haze because of cloudiness formed about the pixels of the beams. When there is haze in the color picture tube, the pixels are not clear but faded. Such haze, which is noted to be caused by both the spherical aberration and the astigmatism, not only deteriorates the sharpness of the pixels of the electron beams but also enlarges the beams spots, thus to deteriorating the resolution of color picture tube.

As will be noted by the equations described later herein, the bad effect of the spherical aberration is in inverse proportion to third power of the aperture size R of the main lenses. The aperture R of the main lenses is in proportion to both the diameters of the first and second accelerating/focusing electrodes 15 and 16.

That is, the focus strength of the main lenses is in reverse proportion to the diameters of the beam passing circular openings 15*a* to 15*c* and 16*a* to 16*c* of the first and second accelerating/focusing electrodes 15 and 16. Thus, the above in-line guns 5 has a problem in that the proper focusing voltages for the electron beam spots or for the pixels are not same.

When representing in equations, both the axis phase derivative of second order $\phi''(z)$ and the spherical aberration component "c" of potential will be represented by the following equations respectively.

$$\phi''(z) \propto (2/\pi s)\cdot(V_2 - V_1)\cdot 1/R$$

and $$c \propto M/16R^3$$

wherein $V_1$ is a voltage of the first accelerating/focusing electrode 15;

$V_2$ is a voltage of the second accelerating/focusing electrode 16;

s is a distance between the first and second accelerating/focusing electrodes 15 and 16;

M is magnification of the main lens; and

R is aperture of the main lens.

When the aperture of the main lenses is increased, both the focus strength and the spherical aberration component of the main lenses will be thus decreased as represented in the following equations.

$$\text{Focus strength} \propto 1/\Delta R$$

and $$\text{Spherical aberration component} \propto 1/(\Delta R)^3$$

When the aperture R of the main lens is increased so as to overcome the above problem caused by the astigmatism, the pixel size or the resulting beam spot size on the screen 9 will be thus reduced in accordance with the following equation and the resolution of the color picture tube will be thus improved.

When letting the resulting beam spot size on the screen 9 be Ds, the spot size Ds will be represented by the following equation.

$$Ds = \sqrt{(Dx + Dsa)^2 + (Dsc)^2}$$

wherein

Dx is a magnified component of a cross-over point dx magnified by the magnification of the main lenses M, otherwise stated, $Dx \propto M\cdot dx$;

Dsa is a magnified component of the electron beam magnified by the spherical aberration component; and Dsc is a magnified component of the electron beam magnified by space charge effect. This Dsc will be represented by the following equation:

$$Dsc=f(r_{sc}/r_i)\propto(i^{1/2}/V^{3/4})\cdot(Z/r_i)$$

wherein i is beam current;

V is a high voltage; and $r_{sc}/r_i$ is beam spread.

However in the above in-line color picture tube, the beam passing circular openings 15*a*, 15*b* and 15*c* of the first accelerating/focusing electrode 15 are arranged in a horizontal line of the X—X direction and in the same plane as shown in FIGS. 3 and 4. In the same manner, the beam passing circular openings 16*a*, 16*b* and 16*c* of the second accelerating/focusing electrode 16 are arranged in a horizontal direction of the X—X direction and in the same plane. Therefore, the diameter of each of the openings 15*a*, 15*b*, 15*c*, 16*a*, 16*b* and 16*c*, the openings forming the main lenses, is inevitably limited to a size not larger than ⅓ of the inner diameter of the neck 7 of the color picture tube 3.

In FIG. 4, the diameter of each of the beam passing openings 15*a* to 15*c* and 16*a* to 16*c* of the first and second accelerating/focusing electrodes 15 and 16 is designated by the alphabet D. The beam separation or the distance between the centers of the beam passing openings 15*a* to 15*c* and 16*a* to 16*c* is designated by the alphabet S. The minimum gap between each of the electrodes 15 and 16 and the inner surface of the neck 7 is designated by the alphabet g. This minimum gap g is the minimum gap that electrically insulates each of the electrodes 15 and 16 from the inner surface of the neck 7. The beam passing openings 15*a* to 15*c*, 16*a* to 16*c* are spaced out at regular intervals $l_1$ while the side openings 15*a* and 15*b*, 16*a* and 16*b* are spaced apart from the opposed side ends of the electrode 15, 16 by the distance $l_2$. In the above guns 5, the interval or the bridge width $l_1$ should be about 1.0 mm. The bridge width $l_1$ is the minimum width allowing the mechanical machining of electrode.

Therefore, $D \leqq S-1$ (mm). When letting the inner diameter of the neck 7 be L, the inner diameter L will be represented by the following equation.

$$D+2(S+g+1)\leqq L$$

Practically, the desired electric insulation between each electrode 15, 16 and the neck 7 is not achieved when the gap g is less than 1.0 mm. In this regard, the diameter D of each beam passing opening should be not larger than (L/3)−2 mm. That is, $D \leqq (L/3)-2$ mm.

The diameter D of each beam passing opening of the electrodes 15 and 16 should be thus limited to the size not larger than ⅓ of the inner diameter L of the neck 7.

Therefore, when enlarging the diameter D of each beam passing opening of the electrodes 15 and 16 of the above described in-line guns 5, either the beam separation S should be increased or the inner diameter L of the neck 7 should be enlarged.

In the typical color picture tube, the electric power to be used for deflecting operation of the deflection yoke 8 should be increased regardless of shapes of the electrodes 15 and 16. Furthermore, such lengthened beam separation S is attended with deterioration of beam convergence characteristics of the main lenses, thus to deteriorate the resolution of the color picture tube.

In order to combat the above problem of deterioration of resolution of the color picture tube, Korean patent Publication No. 89-3825 and Japanese Patent Laid-open Publication No. Sho. 59-215640 disclose improved in-line electron guns for color picture tubes. In each of the above Korean and Japanese in-line guns, effective lens aperture is enlarged by provision of a large aperture of envelope electrode, which envelope electrode also includes therein a backward elliptic plate. In addition, part of the side beam passing openings is removed, thus to somewhat remove the astigmatism of the side beams.

However, the backward plate of the above guns is a flat plate and this practically makes the bridge width between the beam passing openings be not larger than 0.5 mm. Therefore, the desired strength of the electrodes can not be achieved. With the weak strength of the electrodes, the electrodes are apt to be deformed by tools which will be inserted in the beam passing openings when assembling the electrodes into the in-line guns. In addition, the backward plate may be deformed at its bridge portion by welding pressure when welding the bead glass for retaining the gaps between all the electrodes of the guns. In this regard, the above guns disclosed in either the Korean patent or the Japanese patent still deteriorate the convergence characteristics of electron beams or increase the astigmatism, thus to fail in achieving the desired resolution of color picture tube.

As described above, the typical electron guns for color picture tube have a problem that the inner diameter of the neck of the color picture tube can not be enlarged. Another problem of the typical in-line guns is resided in that there should be limit in enlarging both the vertical width and the horizontal width of the beam passing openings due to the structural limit of the beam passing openings. The bridge width between the beam passing openings should be thus narrowed.

Such narrow bridge width of the electrodes of the typical in-line guns weakens the mechanical strength of the electron guns and, as a result, causes a lot of bad products in producing the guns. Furthermore, it is very difficult to treat and handle such guns so that productivity of the guns is adversely impacted.

SUMMARY OF THE INVENTION

It is, therefore, an object of the present invention to provide electron guns for color picture tube which improve the resolution of the color picture tube.

It is another object of the present invention to provide electron guns for color picture tube which not only exhibit the special quality of a large aperture of lens but also achieve the desired mechanical strength of electrodes by arranging ⊂-shaped inner electrode plates in the envelope electrodes respectively, thus to overcome the problem caused in mass production of electron guns due to weak mechanical strength of the electrodes of the guns.

In order to accomplish the above objects, electron guns for color picture tube in accordance with an embodiment of the present invention comprises: a plurality of electron beam sources parallel with each other; a plurality of grids for controlling both radiation amount and crossover of electron beams, the grids including a control grid and an accelerating grid; first and second accelerating/focusing electrodes for focusing the electron beams on a screen; the electron beam sources, the grids and the first and second accelerating/focusing electrodes being axially arranged and spaced out at regular intervals; and the first and second accelerating/focusing electrodes facing with each other and each comprising: a hollow envelope; a rim provided at a facing end of the hollow envelope, the hollow envelopes of the first and second accelerating/focusing electrodes facing each other at their facing ends; a plate electrode placed in the hollow envelope and spaced apart from the rim by a predetermined distance, the plate electrode being holed at its center so as to have a center beam passing opening; and predetermined width of blades integrally provided at opposed sides of the plate electrode.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
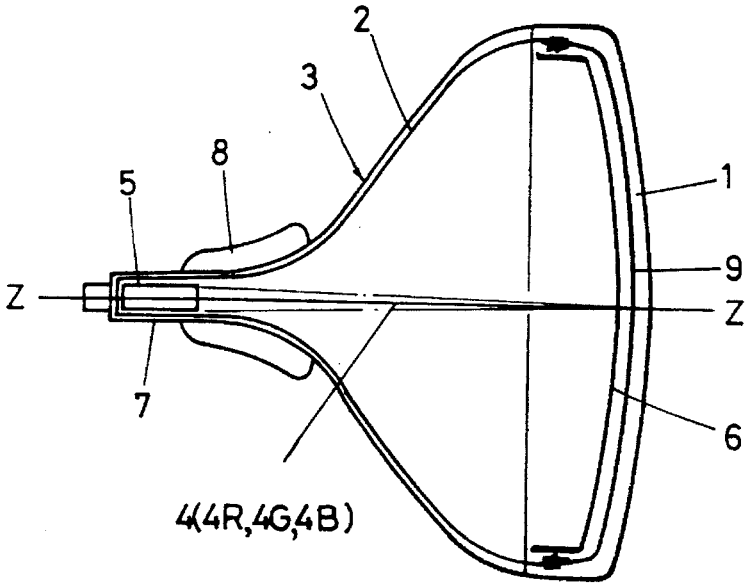
FIG. 1 CONVENTIONAL ART
FIG. 1 is a sectioned view of a color picture tube having typical in-line electron guns.
Figure 2:
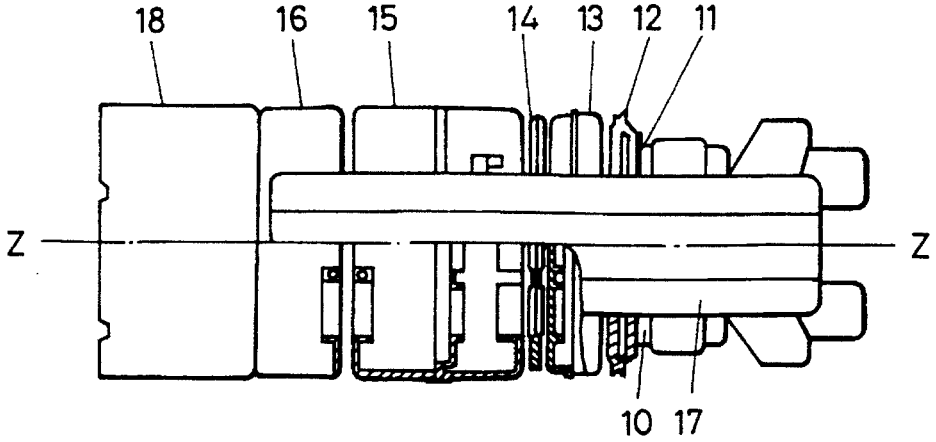
FIG. 2 CONVENTIONAL ART
FIG. 2 is a partially broken enlarged view of the typical in-line electron guns.
Figure 3:
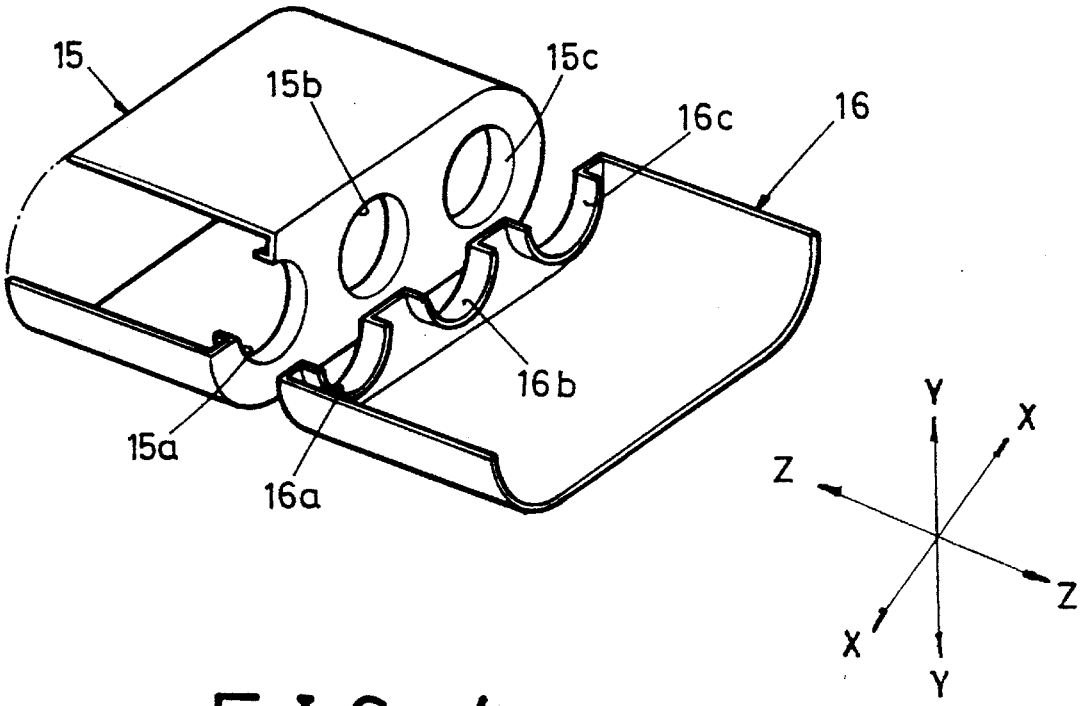
FIG. 3 CONVENTIONAL ART
FIG. 3 is a partially broken perspective view showing representative examples of first and second accelerating/focusing electrodes of the typical in-line electron guns.
Figure 4:
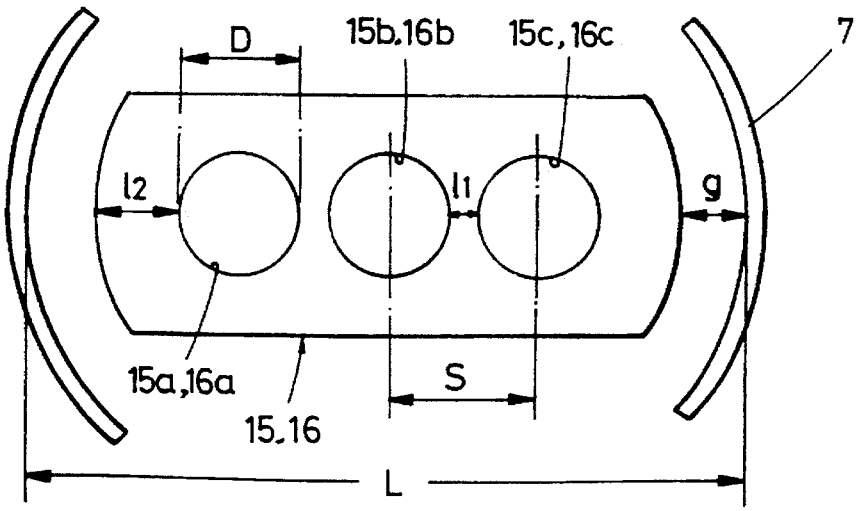
FIG. 4 CONVENTIONAL ART
FIG. 4 is a front view of an accelerating/focusing electrode section of the typical in-line guns when the color picture tube is cross sectioned at the neck.
Figure 5:
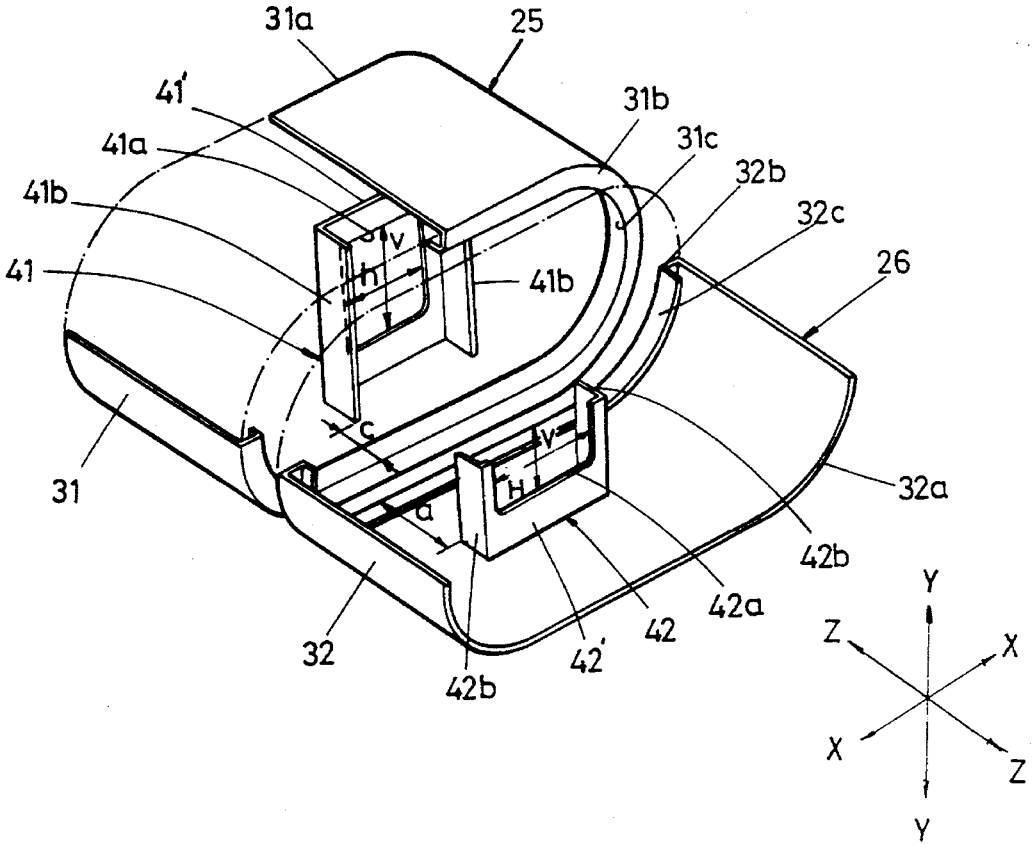
FIG. 5 is a partially broken perspective view showing first and second accelerating/focusing electrodes of in-line electron guns in accordance with a primary embodiment of the present invention.

With reference to FIG. 5, there is shown, in a partially broken perspective view, first and second accelerating/focusing electrodes of in-line electron guns for color picture tube in accordance with a primary embodiment of the present invention.

Figure 6:
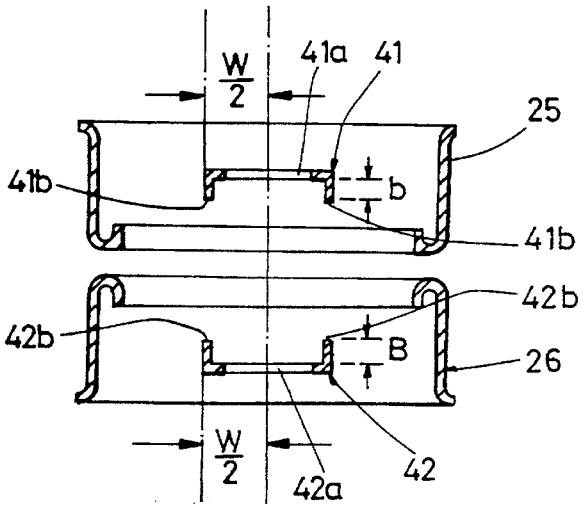
FIG. 6 is sectional view of the first and second accelerating/focusing electrodes of FIG. 5.

In FIG. 5, the first and second accelerating/focusing electrodes of the in-line electron guns are designated by the numerals 25 and 26 respectively. The first and second accelerating/focusing electrodes 25 and 26 includes hollow noncircular envelope electrodes 31 and 32 respectively. Vertically placed in each of the envelope electrodes 31 and 32 is an inner electrode plate or an electrostatic field control electrode 41, 42. Each electrostatic field control electrode 41, 42 is ⊂-shaped in cross section. Each of the envelope electrodes 31 and 32 comprises a predetermined length of noncircular envelope 31*a*, 32*a*, which envelope 31*a*, 32*a* is simply opened at one end thereof. Radially, inwardly and integrally extending from the other ends of the noncircular envelopes 31*a* and 32*a* are predetermined width of rim parts 31*b* and 32*b*. Those rim parts 31*b* and 32*b* face each other as shown in FIG. 5. Each rim part 31*b*, 32*b* shows a generally elliptic shape whose top and bottom portions are straight portions but opposed side portions are arcuate portions. The straight top and bottom portions and the arcuate side portions are integrated into the generally elliptic rim part. Integrally backward extending from inside edge of each rim part 31*b*, 32*b* is a predetermined width of ring part 31*c*, 32*c*. The rim part 31*b*, 32*b* of each envelope electrode 31, 32 cooperates with a corresponding ring part 31*c*, 32*c* so as to define an opening at the other end of the envelope electrode 31, 32. In FIG. 6, the first and second accelerating/focusing electrodes 25 and 26 are shown as if they were spaced out at a considerable interval. However, it should be understood that the electrodes 25 and 26 are practically almost touching each other with a minute space therebetween.

In each envelope 31*a*, 32*a*, the electrostatic field control electrode 41, 42 is vertically placed in back of a corresponding rim part 31*b*, 32*b*. The electrostatic field control electrodes 41 and 42 are spaced apart from the rim parts 31*b* and 32*b* by predetermined backward distances "c" and "a" respectively. The ⊂-shaped electrodes 41 and 42 are arranged on the Z—Z axis in such a manner that they face each other and their opposed blades 41*b* and 42*b*, which blades will be described later herein, are directed to each other. Along which Z—Z axis, the center electron beam or the green beam 4G will pass. The electrostatic field control electrodes 41 and 42 cross with the Z—Z axis at right angle. In the primary embodiment, the electrodes 41 and 42 are also bored at the centers of their plate electrodes 41' and 42' sided by the blades 41*b* and 42*b*. Thus, the plate electrodes 41' and 42' have their respective rectangular openings 41*a* and 42*a* for passing the center beam 4G. The vertical heights v and V of the center beam passing openings 41*a* and 42*a* are different from each other. That is, the vertical height V of the opening 42*a* is shorter than the vertical height v of the opening 41*a*.

In the openings 41*a* and 42*a*, it is preferred to make the heights v and V be longer than the widths h and H respectively. In addition, the widths h and H of the openings 41*a* and 42*a* are different from each other. Definite dimension for both the height v and V and the widths h and H of the openings 41*a* and 42*a* according to the primary embodiment will be given later herein.

Figure 11A:
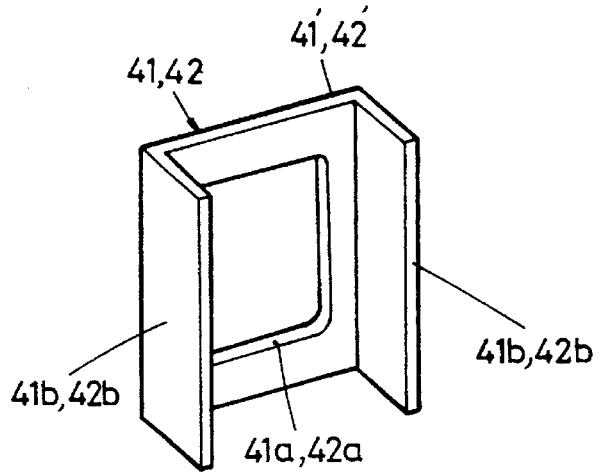
FIGS. 11A to 11C are perspective views of electrostatic field control electrodes having different shape of center beam passing openings respectively.

One electrostatic field control electrode 41, 42 according to the primary embodiment is shown in FIG. 11A. As shown in FIG. 11A, the center beam passing openings 41*a* and 41*b* of the electrodes 41 and 42 of the primary embodiment are rectangular openings.

Figure 11B:
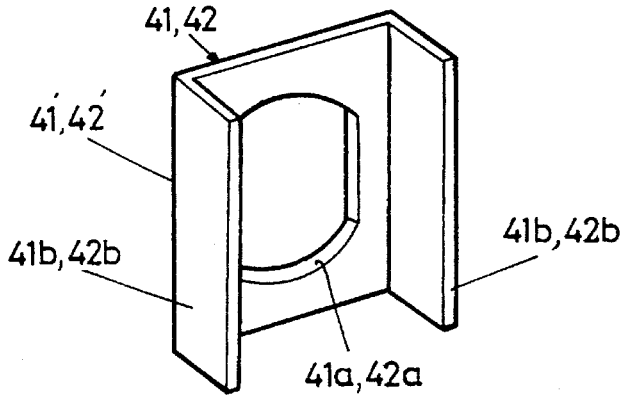
Figure 11C:
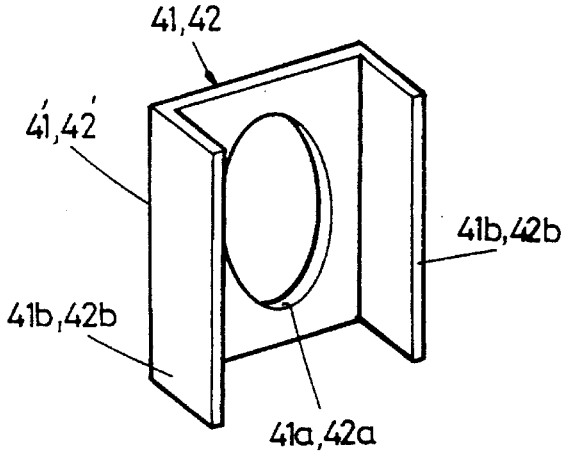

However, it should be understood that there exist a variety of different opening configurations which yield the same result as that described for the rectangular openings 41*a* and 42*a* without affecting the functioning of this invention. For example, the top and bottom sides of each beam passing opening 41*a*, 42*a* may be arcuate while the opposed straight sides of the opening 41*a*, 42*a* remain as shown in FIG. 11B. In this embodiment, the vertical height of the beam passing opening is longer than the horizontal width of the opening in the same manner as described for the primary embodiment. Alternatively, each beam passing opening 41*a*, 42*a* may be an erect elliptic opening as shown in FIG. 11C. In this erect elliptic opening 41*a*, 42*a*, the vertical diameter is longer than the horizontal diameter.

As shown in FIGS. 5 and 6, the plate electrode 41', 42' of each electrostatic field control electrode 25 and 26 is sided by opposed blades 41*b*, 42*b*. The blades 41*b* and 42*b* of the electrodes 25 and 26 have predetermined widths b and B that are different from each other. In the drawings, the opposed blades 41*b* and 42*b* integrally extend from their respective plate electrodes 41' and 42' respectively. However, it should be understood that the blades 41*b* and 42*b* may be separately formed from their respective plate electrodes 41' and 42'.

Figure 7:
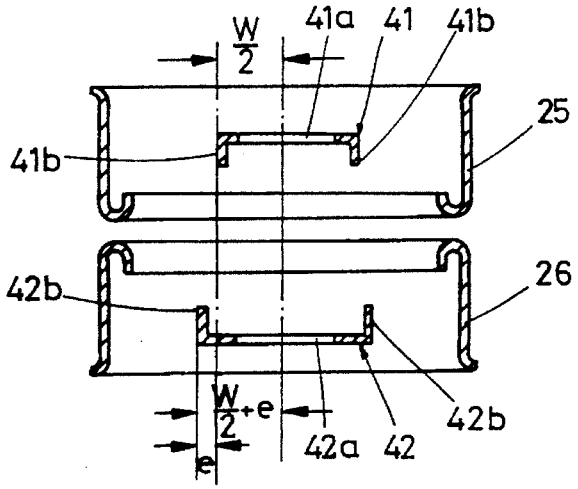
FIG. 7 is a view corresponding to FIG. 6, but showing electrostatic field control electrodes offset from each other.

Turning to FIG. 6 that is a sectional view of the first and second electrodes 25 and 26 of FIG. 5, each blade 41*b*, 42*b* is parallel with the center axis of a corresponding beam passing opening 41*a*, 42*a* and is spaced apart from the center axis of opening 41*a*, 42*a* by a distance of W/2. Here, the letter W denotes the gap between the blades of each electrostatic field control electrode. In the embodiment of FIG. 6, the blades 41*a* and 42*a* precisely face each other so that there-exists no offset in the blades 41*a* and 42*a*. However, the blades 41*b* and 42*b* may be offset from each other as shown in FIG. 7. That is, the opposed blades 42*b* of the second electrostatic field control electrode 42 may be spaced apart from the center axis of the opening 42*b* by a distance "W/2+e" respectively while the opposed blades 41*b* of the first electrostatic field control electrode 41 are spaced apart from the center axis of the opening 41*b* by the distance "W/2". In the distance W/2+e, the alphabet "e" denotes an offset distance of the blades and is about 50 μm.

Figure 12A:
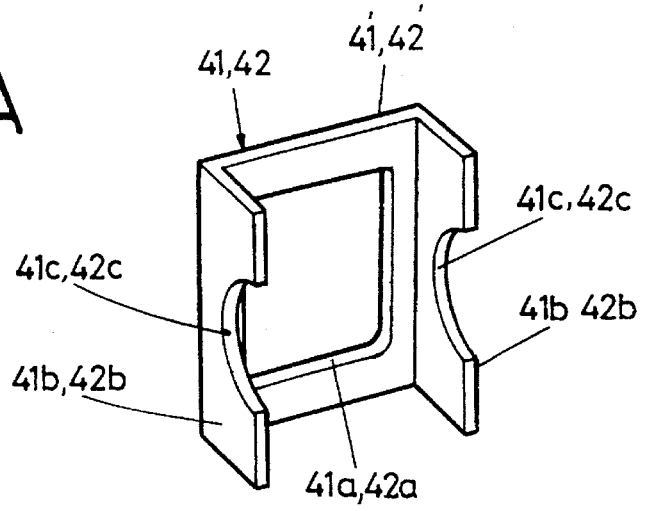
FIGS. 12A to 12C are perspective views of electrostatic field control electrodes having different shape of center beam passing openings and rounded notches respectively.
Figure 12B:
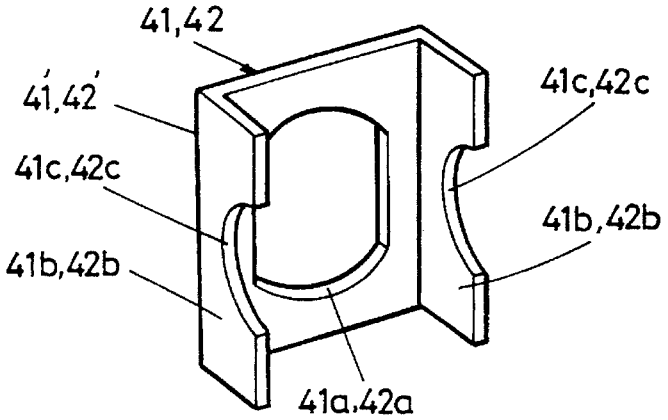
Figure 12C:
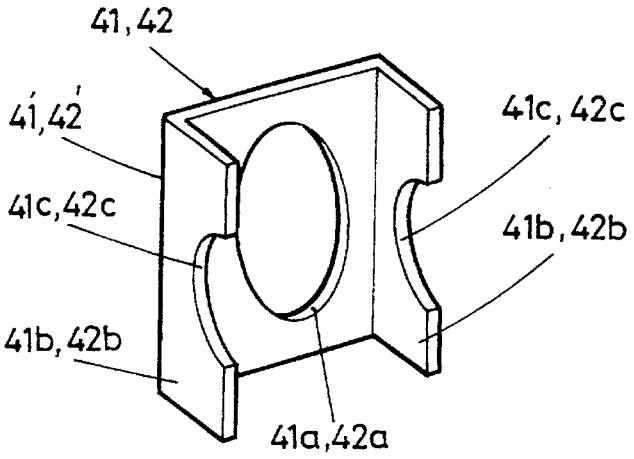

In the present invention, the opposed blades 41*b*, 42*b* function as opposed electrode surfaces of a corresponding electrostatic field control electrode 41, 42. The opposed blades 41*b* and 42*b* are thus preferably directed to each other so as to be close to each other as shown in FIGS. 5 to 7. However, it should be understood that the positions of the blades 41*b* and 42*b* are not limited to the above positions of FIGS. 5 to 7 but may be changed as will be represented in second to fourth embodiments. Each blade 41*b*, 42*b* may be provided with a rounded notch 41*c*, 42*c* as shown in FIGS. 12A to 12C. The rounded notch 41*c*, 42*c* is formed on the center of the free edge of each blade 41*b*, 42*b*. The general shapes of the electrostatic field control electrodes of FIGS. 12A to 12C remain the same as in the electrostatic field control electrodes of FIGS. 11A to 11C, but the blades 41*b* and 42*b* are altered to have the rounded notches 41*c* and 42*c* respectively.

The above first and second accelerating/focusing electrodes 25 and 26 of the primary embodiment cooperate with each other to form the electrostatic main lenses of the in-line guns of this invention. With the rim parts 31*b* and 32*b* of the electrodes 25 and 26, the potentials of the first and second electrodes 25 and 26 infiltrate far into the electrodes 25 and 26 respectively, thus to achieve enlarged space effect. This provides aperture enlarging effect for the electrostatic main lenses.

In the common space defined by both the rim parts 31*b* and 32*b*, the X—X directional or horizontal potential infiltration is more intense than the Y—Y directional or vertical potential infiltration. The effective aperture of the main lenses is thus remarkably enlarged in the horizontal direction than in the vertical direction. Therefore, the focus strength of the main lenses in the horizontal or X—X direction is remarkably weakened than the focus strength of the main lenses in the vertical or Y—Y direction. With the focus strength difference between the X—X direction and the Y—Y direction, the focuses of the main lenses become different from each other and, as a result, there may be generated astigmatism in the electron guns.

In order to remove the astigmatism, the electron guns according to the primary embodiment of this invention are provided with the electrostatic field control electrodes 41 and 42 that are vertically placed in their respective envelope electrodes 31 and 32 and cross with the center beam passing axis or Z—Z axis. The electrodes 41 and 42 are adapted for control of electrostatic field.

When controlling the electrostatic field that infiltrates into the center beam passing openings 41*a* and 42*a* of the above control electrodes 41 and 42, the astigmatism will be removed in the following manner.

In accordance with the above primary embodiment, each control electrode 41, 42 is sided by the blades 41*b*, 42*b* at the opposed sides thereof. The blade sided plate electrode 41', 42' of each electrostatic field control electrode 41, 42 is bored at its center, thus to have a predetermined shape of center beam passing opening 41*a*, 42*a*. In this primary embodiment, the blades 41*b* and 42*b* are directed to the main lenses or to the rim parts 31*b* and 32*b* of the electrodes 25 and 26.

In the in-line guns of the primary embodiment, the blades 41*b* and 42*b* of the main lens forming first and second electrodes 25 and 26 are arranged in the center beam passing axis and cross with the axis at right angle. The blades 41*b* and 42*b* thus strengthen the horizontal or X—X directional focus strength of the main lenses, which lenses are formed by the rim parts 31*b* and 32*b*. The horizontal and vertical focus strengths of the main lenses balance with each other, thus to effectively remove the astigmatism.

The blades 41*b* and 42*b* of the electrostatic field control electrodes 41 and 42 particularly influence the removing effect of the astigmatism of the side beams 4R and 4B. The optimal data for the size of the blades 41*b* and 42*b* will be obtained from the graph of FIG. 13.

Figure 13:
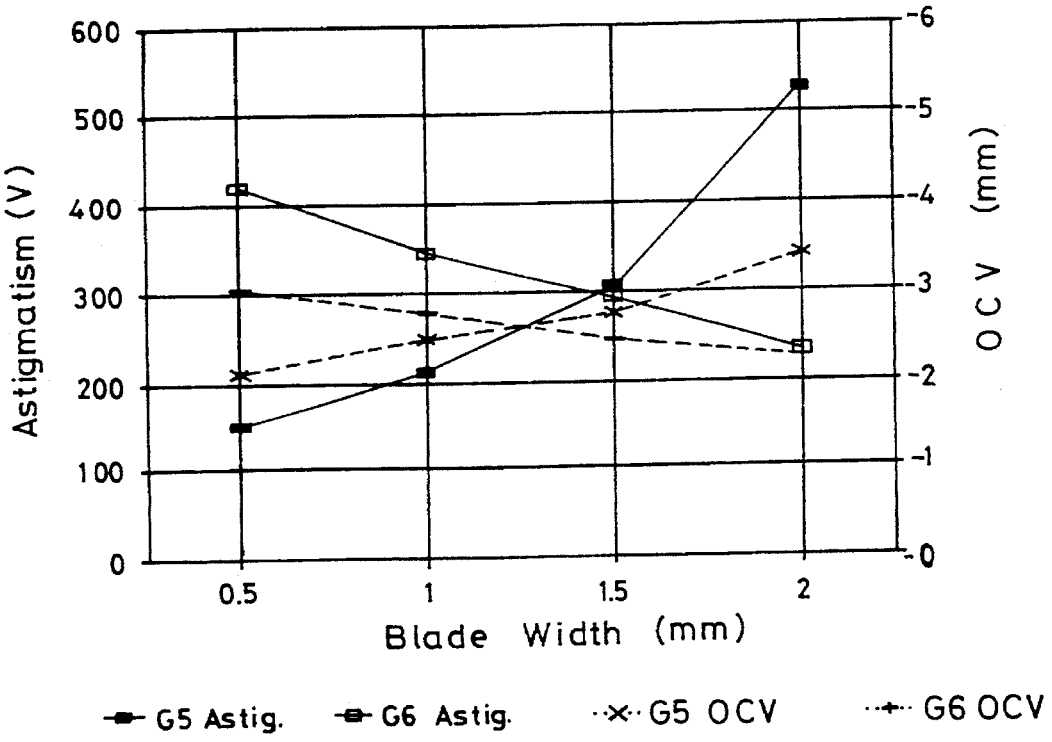
FIG. 13 is a graph showing both astigmatism and static convergence characteristic OCV as a function of blade width for the electron guns of the present invention.
Figure 15:
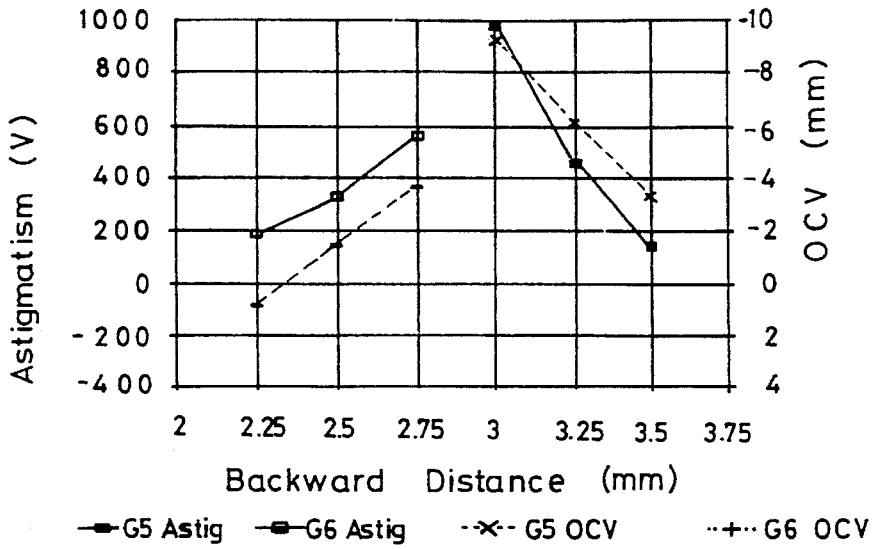
FIG. 15 is a graph showing both astigmatism and static convergence characteristic OCV as a function of backward distance of the electrostatic field control electrode for the electron guns of the present invention.
Figure 16:
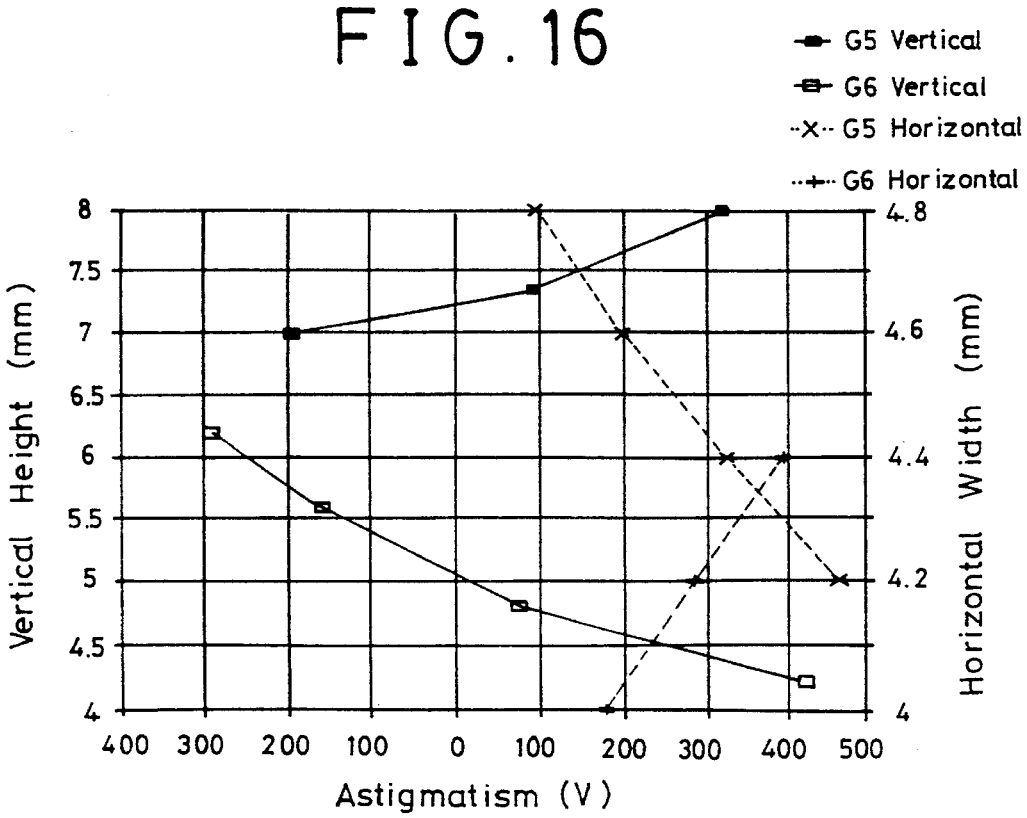
FIG. 16 is a graph showing the astigmatism as a function of size of center beam passing opening of the electrostatic field control electrode for the electron guns of the present invention.

As shown in the graph of FIG. 13, the static convergence characteristic OCV of the guns should vary when controlling the astigmatism. However, the widths b and B of blades 41*b* and 42*b* will be set by a common optimal point of both the astigmatism and the OCV while preferentially considering the astigmatism. As represented in the graph of FIG. 15, both astigmatism and OCV are repeatedly, optimally, minutely and simultaneously controlled by retreating the electrostatic field control electrodes 41 and 42 from the rim parts 31*b* and 32*b* into the first and second electrodes 25 and 26 by predetermined backward distances "a" and "c" respectively. Here, the backward distances "a" and "c" are distances between the blades 41*b* and 42*b* and their respective rim parts 31*b* and 32*b* as shown in FIG. 5. In addition, both the OCV and the widths of the center beam passing openings 41*a* and 42*a* of the electrostatic field control electrodes 41 and 42 are optimally set. In the in-line guns for color picture tube of the primary embodiment, the adjustable astigmatism is ranged from +200 volt to +400 volt.

Figure 14:
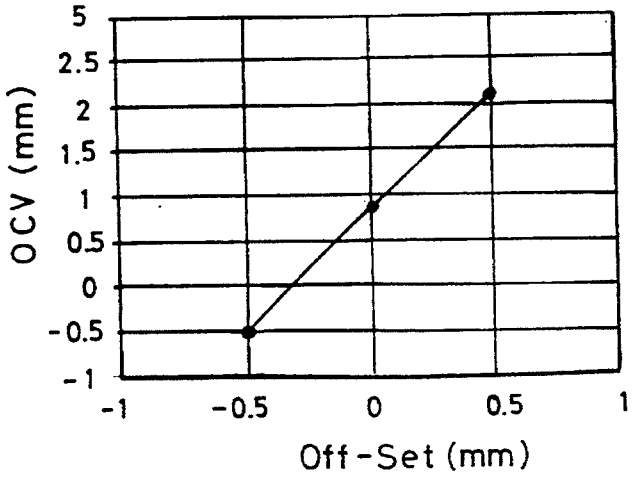
FIG. 14 is a graph showing the static convergence characteristic OCV as a function of offset of the electrostatic field control electrode for the electron guns of the present invention.

In the present invention, there may be no offset distance between the electrostatic field control electrodes 41 and 42 as shown in FIG. 6. Alternatively, the electrostatic field control electrodes 41 and 42 may be offset from each other by the offset distance "e" of about 50 μm. The offset distance "e" is obtained from the above data and the offset arrangement of the electrodes 41 and 42 is shown in FIG. 7. The OCV as a function of the offset distance is represented in the graph of FIG. 14. In the graph of FIG. 14, it is noted that the optimal OCV in response to the offset distance approaches zero.

In the present invention, the OCV is designed, considering a variety of factors such as color picture tube size, deflection angle and applied voltages.

The definite dimension of the first and second accelerating/focusing electrodes 25 and 26 of the electron guns according to the primary embodiment is as follows.

1. Gap "W" between blades 41*b*, 42*b* of the electrostatic field control electrode 41, 42 of each electrode 25, 26; W=6.1 mm.
2. Widths "b" and "B" of the blades 41*b* and 42*b*; b, B= 1.5 mm.
3. Backward distance "a" of blade 42*b* of second electrode 26; a=2.4 mm.
4. Backward distance "c" of blade 41*b* of first electrode 5; c=3.5 mm.
5. Vertical height "V" of beam passing opening 42*a* of control electrode 42 of the second electrode 26; V=4.4 mm.
6. Horizontal width "H" of beam passing opening 42*a* of control electrode 42 of the second electrode 26; H=4.2 mm.
7. Vertical height "v" of beam passing opening 41*a* of control electrode 41 of the first electrode 25; v=8.0 mm.
8. Horizontal width "h" of beam passing opening 41*a* of control electrode 41 of the first electrode 25; h=4.4 mm.
9. Horizontal width of each rim part 31*b*, 32*b*; 18 mm.
10. Vertical height of each rim part 31*b*, 32*b*; 8.0 mm.
11. Thickness of each electrostatic field control electrode 41, 42; 0.5 mm.

Background of calculation of the above dimension of the first and second accelerating/focusing electrodes 25 and 26 will be given with reference to the graphs of FIGS. 13 to 16.

From the graph of FIG. 13, it is noted that both astigmatisms and OCVs of both the center beam 4G and the side beams 4R and 4B are good when the widths "b" and "B" of the blades 41*b* and 42*b* of the first and second electrodes 25 and 26 are ranged from about 1.2 mm to about 1.8 mm. From the graph of FIG. 15, it is noted that both astigmatisms and OCVs of both the center beam 4G and the side beams 4R and 4B are good when the backward distances "c" and "a" of the blades 41*b* and 42*b* of first and second electrodes 25 and 26 are ranged from about 3.3 mm to about 3.7 mm and ranged from about 2.3 mm to about 2.8 mm respectively. From the graph of FIG. 16, it is noted that astigmatism of the center beam 4G is good when the horizontal width h and vertical height v of the beam passing opening 41*a* of the first electrode 25 are ranged from about 4.2 mm to about 4.8 mm and ranged from about 7.0 mm to about 8.0 mm respectively. From the graph of FIG. 16, it is noted that astigmatism of the center beam 4G is good when the horizontal width H and vertical height V of the beam passing opening 42*a* of the second electrode 26 are ranged from about 4.2 mm to about 4.6 mm and ranged from about 4.2 mm to about 5.0 mm respectively.

Figure 8:
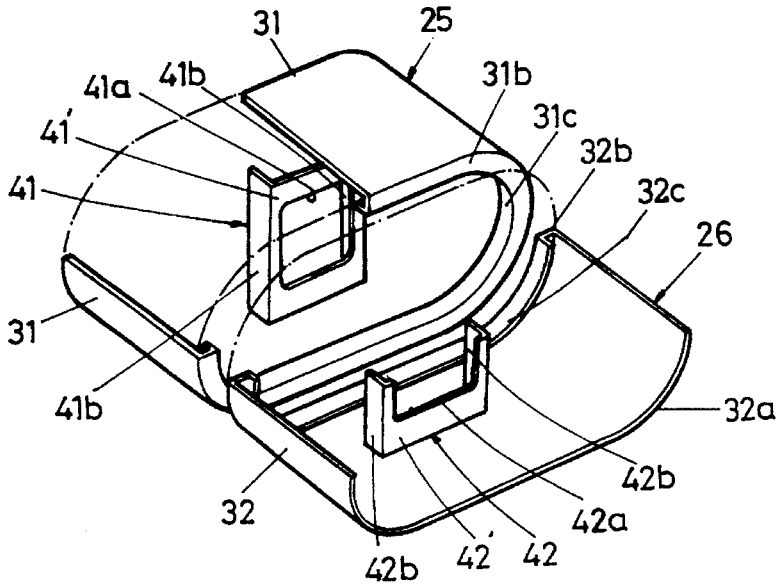
FIGS. 8 to 10 are views corresponding to FIG. 5, but showing second to fourth embodiments of the present invention respectively.
Figure 9:
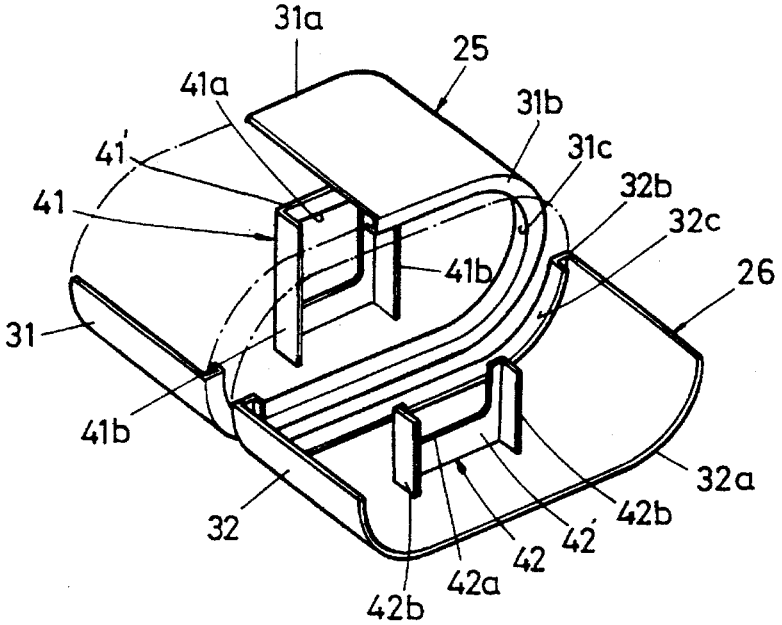
Figure 10:
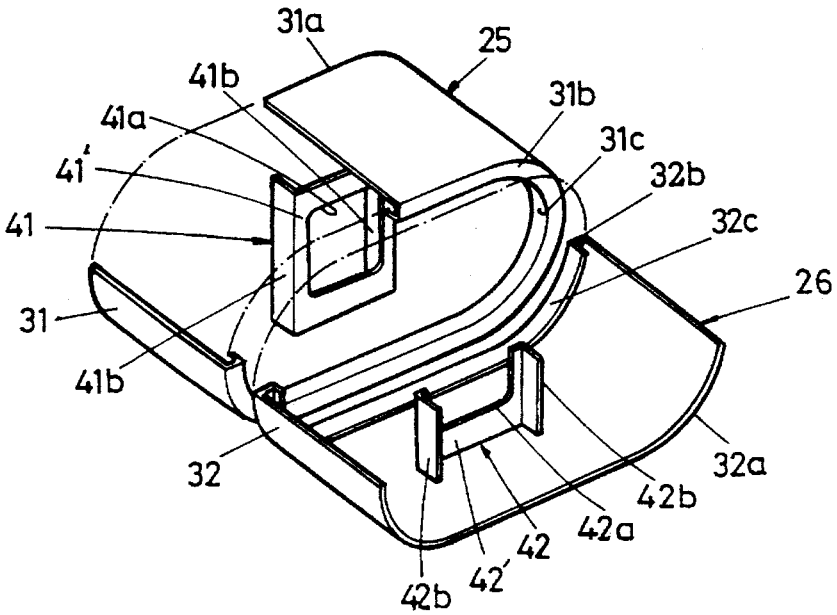

FIGS. 8 to 10 show first and second accelerating/focusing electrodes of in-line electron guns for color picture tube in accordance with the second to fourth embodiments of the present invention respectively. As represented in FIGS. 8 to 10, the blades 41*b* and 42*b* of the electrostatic field control electrodes 41 and 42 placed in their respective envelope electrodes 31 and 32 may be directed either in the same direction or in opposed directions. Such positional designing change of the blades 41*b* and 42*b* will be attended with adjusting of the dimension such as the widths of blades 41*b* and 42*b* and the backward distances of the blades 41*b* and 42*b*.

The center beam passing openings 41*a* and 42*a* of the second embodiment of FIG. 8 are placed far from the electron beam sources or the cathodes. That is, the blades 41*b* and 42*b* of this second embodiment are directed in the same direction toward the cathodes and placed to be close to the cathodes. On the contrary, the center beam passing openings 41*a* and 42*a* of the third embodiment of FIG. 9 are placed to be close to the cathodes. That is, the blades 41*b* and 42*b* of this third embodiment are directed, in the same direction, away from the cathodes and placed far from the cathodes. In the fourth embodiment of FIG. 10, the center beam passing openings 41*a* and 42*a* are close by each other as shown in FIG. 10. That is, the blades 41*a* and 42*a* of this fourth embodiment are directed in opposed directions.

If briefly described, the second to fourth embodiments change the positions of the electrostatic field control electrodes 41 and 42 as shown in FIGS. 8 to 10 respectively. With such change of positions of electrodes 41 and 42, the astigmatisms of both the center beam 4G and the side beams 4R and 4B will be equalized to each other.

That is, the second embodiment of FIG. 8 shows small astigmatism of the center beam 4G so that this embodiment will be effective structure when the side beams 4R and 4B have small astigmatisms. On the contrary, the third embodiment of FIG. 9 shows large astigmatism of the center beam 4G so that this embodiment will be effective structure when the side beams 4R and 4B have large astigmatisms. The fourth embodiment of FIG. 10 generates center beam astigmatism similar to that of the primary embodiment of FIG. 5 when the astigmatism characteristics of first and second accelerating/focusing electrodes 25 and 26 are combined with each other. However in the fourth embodiment, the astigmatism characteristic of first accelerating/focusing electrode 25 is more prominent than that of the second accelerating/focusing electrode 26. The astigmatism of the primary embodiment is thus smaller than that of the fourth embodiment. In addition, the center beam passing openings 41*a* and 42*a* of the fourth embodiment are close by each other as described above. The focus strength of main lenses of the fourth embodiment is thus stronger than that of the primary embodiment so that the focus of the main lenses is shortened.

In the graphs of FIG. 13 to 16, G5 and G6 denote the first and second accelerating/focusing electrodes 25 and 26 respectively.

The characteristics of the first and second accelerating/focusing electrodes according to the primary, second, third and fourth embodiments of the present invention are given in following Table.

TABLE

| | beam pass opening position* | | center beam astigmatism | |
|---|---|---|---|---|
| | 1st elect. 25 | 2nd elect. 26 | 1st elect. 25 | 2nd elect. 26 |
| 1st embod. | far | far | reduced[1] | increased[1] |
| 2nd embod. | close | far | increased[2] | increased[1] |

TABLE-continued

| | beam pass opening position* | | center beam astigmatism | |
|---|---|---|---|---|
| | 1st elect. 25 | 2nd elect. 26 | 1st elect. 25 | 2nd elect. 26 |
| 3rd embod. | far | close | reduced[1] | reduced[2] |
| 4th embod. | far | close | increased[2] | reduced[2] |

In the Table,
"position*" means the positions of the beam passing openings spaced apart from facing surfaces or rim parts 31b and 32b of the first and second electrodes 25 and 26;
"reduced[1]" means that the astigmatism is more reduced than when the opening 41a is close to the rim part 31b of electrode 25;
"reduced[2]" means that the astigmatism is more reduced than when the opening 42a is far from the rim part 32b of electrode 26;
"increased[1]" mean that the astigmatism is more increased than when the opening 42a is close to the rim part 32b of the electrode 26; and
"increased[2]" means that the astigmatism is more increased than when the opening 41a is far from the rim part 31b of electrode 25.

Please noted that the above result shown in Table are given when the beam passing openings 41*a* and 42*a* are erect openings whose vertical heights are longer than the horizontal widths and the apertures of the first and second electrodes 25 and 26 are same with each other and, at the same time, the blade backward distances of the electrodes 25 and 26 are fixed.

As described above, the electron guns for color picture tube according to the present invention enlarges the facing surfaces of the first and second accelerating/focusing electrodes, thus to form effective large aperture of electrostatic main lenses and to remarkably reduce bad effect caused by lens spherical aberration. In addition, the astigmatism is removed by ⊂-shaped electrostatic field control electrodes, thus to remarkably improve resolution of color picture tube. The ⊂-shaped electrostatic field control electrodes are arranged in their respective envelope electrodes of the first and second accelerating/focusing electrodes, thus to achieve desired mechanical strength of the first and second accelerating/focusing electrodes. With the improved mechanical strength, possible problem caused in production of guns due to weak mechanical strength is thus completely overcome.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. Electron guns for a color picture tube comprising:

a plurality of electron beam sources parallel with each other;

a plurality of grids for controlling both a radiation amount and a crossover of electron beams of said electron beam sources, said grids including a control grid and an accelerating grid;

first and second accelerating/focusing electrodes for focusing the electron beams on a screen;

said electron beam sources, said grids and said first and second accelerating/focusing electrodes being axially arranged and spaced out at regular intervals; and said first and second accelerating/focusing electrodes facing each other and each comprising:

a hollow envelope;

a rim provided at a facing end of said hollow envelope, the hollow envelopes of the first and second accelerating/focusing electrodes facing each other at their facing ends;

a plate electrode placed in said hollow envelope and spaced apart from the rim by a predetermined distance, said plate electrode having a hole at its center and said hole defining a center beam passing opening; and first and second blades respectively and integrally provided at opposed sides of said plate electrode, said blades being separated from one another by a predetermined distance.

2. The electron guns for color picture tube according to claim 1, wherein a vertical height of the center beam passing opening of each accelerating/focusing electrode is longer than a horizontal width of the center beam passing opening.

3. The electron guns for color picture tube according to claim 1, wherein a vertical height of the center beam passing opening of the second accelerating/focusing electrode is shorter than a vertical height of the center beam passing opening of the first accelerating/focusing electrode.

4. The electron guns for color picture tube according to claim 1, wherein horizontal widths of the center beam passing openings of the first and second accelerating/focusing electrodes are different from each other.

5. The electron guns for color picture tube according to claim 1, wherein the center beam passing opening of each accelerating/focusing electrode has at least two straight sides.

6. The electron guns for color picture tube according to claim 1, wherein the center beam passing opening of each accelerating/focusing electrode is a polygonal opening.

7. The electron guns for color picture tube according to claim 6, wherein the center beam passing opening of each accelerating/focusing electrode is a rectangular opening.

8. The electron guns for color picture tube according to claim 1, wherein the center beam passing opening of each accelerating/focusing electrode is an erect elliptic opening whose vertical diameter is longer than horizontal diameter.

9. The electron guns for color picture tube according to claim 1, wherein the center beam passing opening of each accelerating/focusing electrode is defined by two straight sides and two arcuate sides, vertical height of the center beam passing opening being longer than horizontal width.

10. The electron guns for color picture tube according to claim 1, wherein the blades of said first and second accelerating/focusing electrodes are parallel with a common center beam passing axis and spaced apart from said axis by the same distance.

11. The electron guns for color picture tube according to claim 1, wherein the blades of said first and second accelerating/focusing electrodes are parallel with a common center beam passing axis but the distance between each blade of the first accelerating/focusing electrode and the axis is different from the distance between each blade of the second accelerating/focusing electrode and the axis so that said blades of the first and second accelerating/focusing electrodes are offset from each other.

12. The electron guns for color picture tube according to claim 1, wherein the blades of said first and second accelerating/focusing electrodes are placed far from their respective rims.

13. The electron guns for color picture tube according to claim 1, wherein the blades of said first and second accelerating/focusing electrodes are placed far from said electron beam sources.

14. The electron guns for color picture tube according to claim 1, wherein the blades of said first and second accelerating/focusing electrodes are placed to be close to said electron beam sources.

15. The electron guns for color picture tube according to claim 1, wherein the blades of said first and second accelerating/focusing electrodes are placed to be close to their respective rims.

16. The electron guns for color picture tube according to claim 1, wherein the width of each blade of the first accelerating/focusing electrode is different from that of the second accelerating/focusing electrode.

17. The electron guns for color picture tube according to claim 1, wherein the blades of said first and second accelerating/focusing electrodes are spaced apart from their respective rims by different distances.

18. The electron guns for color picture tube according to claim 1, wherein each blade of said first and second accelerating/focusing electrodes is provided with a rounded notch on free edge thereof.

* * * * *